US005128158A

United States Patent [19]

Chartrain et al.

[11] Patent Number: 5,128,158

[45] Date of Patent: Jul. 7, 1992

[54] COOKING PROCESS WITH AN OVEN HEATED BY THE COMBINATION OF MICROWAVES, CONVECTION AND BROILING

[75] Inventors: Pierre Chartrain, Bourguebus; Olivier H. J. Gensbittel, Malissard; Gerard R. G. Launay, Cauvicourt, all of France

[73] Assignee: Moulinex (Societe Anonyme), Bagnolet, France

[21] Appl. No.: 673,519

[22] Filed: Mar. 22, 1991

[51] Int. Cl.[5] ..... H05B 6/00

[52] U.S. Cl. ..... 426/233; 426/243; 426/523

[58] Field of Search ..... 426/243, 233, 523; 219/10.55 M

[56] References Cited

U.S. PATENT DOCUMENTS 4,318,931 3/1982 Schiffmann et al. ..... 426/243

4,812,606 3/1989 Eke ..... 426/243

*Primary Examiner*—George Yeung

*Attorney, Agent, or Firm*—Young & Thompson

[57] ABSTRACT

Cooking process with an oven comprising a cooking chamber (1) and a control device (2) supplying a convection resistance (3), a broiling resistance (4) and a magnetron (5). During the temperature increase phase (a), the control device supplies the convection resistance continuously and the broiling resistance according to a start-stop cycle of predetermined period ($t_1$), while the microwave energy is applied periodically during each stopped time ($t_3$) of the broiler for a time ($t_4$) such that, for a previously set predetermined time ($t_5$), the microwave time is equal to the shorter of the times, namely the predetermined time ($t_5$), or the stopped time ($t_3$) of the broiler. This process is particularly applicable to kitchen ovens.

5 Claims, 1 Drawing Sheet

COOKING PROCESS WITH AN OVEN HEATED BY THE COMBINATION OF MICROWAVES, CONVECTION AND BROILING

The invention relates to a cooking process with an oven heated by the combination of microwaves, convection and broiling, comprising a cooking chamber and a control device supplying from a source of electrical energy of limited rated power, a convection resistance, a broiling resistance and a magnetron during two cooking phases, namely, a phase of temperature increase in the course of which the temperature of the chamber rises to a predetermined temperature selected by the user, then a regulated phase in the course of which the temperature of the chamber is regulated relative to said predetermined temperature by means of a thermostatic device, the sum of the power drawn respectively by the two resistances and the microwave energy being less than the rated power of the energy source.

In ovens of this type, the temperature increase phase is relatively long. Thus, during this phase, only the convection resistance is fed, the broiler not being used so as to avoid burning the surface of the food to be cooked (formation of a "crust") and the microwave energy being applied only during the regulated phase.

The invention has for its object overcoming this drawback and in particular shortening substantially the temperature increase phase in this type of oven.

According to the invention, during the temperature increase phase, the control device supplies the convection resistance continuously at full power and the broiling resistance according to a stop-start cycle whose period is predetermined, while the microwave energy is applied periodically during each stopped time of the broiling resistance for a time of application such that, for a time of regulation previously set by the user, said duration is equal to the shorter of the two times, namely the control time or the stopped time of the broiling resistance.

Thus, during the temperature increase phase, the convection resistance continuously heats while the broiling resistance heats intermittently, thereby rapidly increasing the temperature of the chamber and not excessively broiling the surface of the food to be cooked. The microwave energy being applied during the stopped times of the broiler, the rated power of the source is not exceeded and the foodstuff begins to heat from the interior, which balances the internal temperature with the surface temperature and thereby prevents the formation of a "crust". The temperature increase phase is therefore considerably reduced while maintaining good cooking quality.

The characteristics and advantages of the invention will become more apparent from the description which follows, by way of example, with reference to the accompanying drawing, in which.

Figure 1:
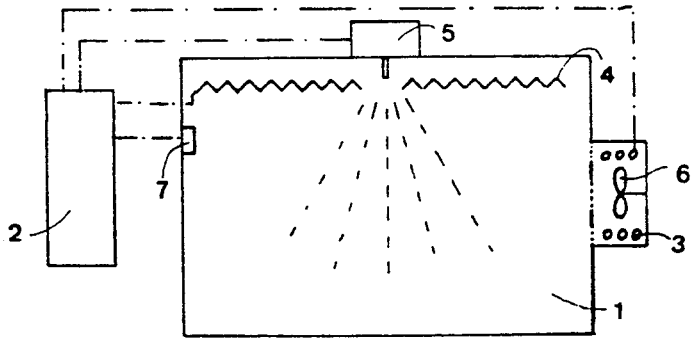
FIG. 1 is a schematic view of an oven according to the invention.

The cooking oven with combined heating by convection, broiling and microwaves, shown in FIG. 1, comprises a cooking chamber 1 and an electronic control device 2, known per se, feeding from a source of electrical energy (not shown) a convection resistance 3, a broiling resistance 4 and a magnetron 5.

The convection can be either natural, the convection resistance then boing a baseplate resistance (not shown) for forced, the convection resistance 3 surrounding a fan 6 adapted to blow hot air into the interior of chamber 1.

The energy source has a limited rated power (limited to 16 amps) for a voltage of 220 volts corresponding to a rated power of 3520 watts). The sum of the powers Pa, Pb, Pc drawn from the source by the respective resistances 3, 4 and the microwave energy supplied by the magnetron 5 should be less than the rated power of the energy source. The maximum powers Pa, Pb, Pc drawn from the source by the microwave energy, the convection resistance 3 and the broiling resistance 4 are selected respectively to be about 1400, 1400 and 1500 watts.

Figure 2:
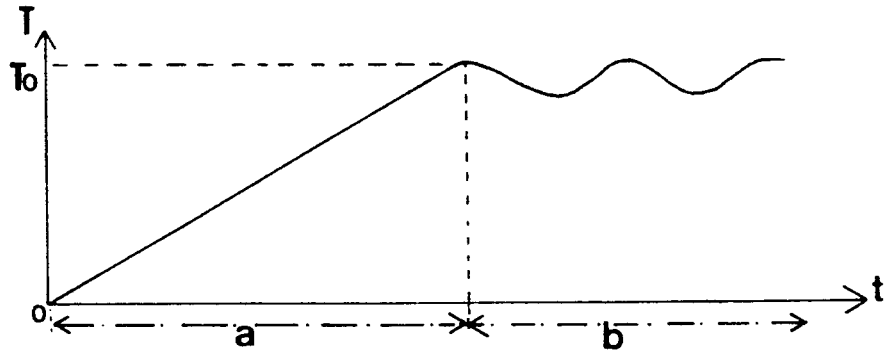
FIG. 2 is a graphical representation illustrating the temperature curve of the chamber during the two cooking phases.

As will be seen from FIG. 2, which shows the temperature curve T of the chamber 1 as a function of time t, the two resistances 3, 4 and the magnetron 5 are supplied by the control device 2 during two phases of cooking a, b, namely a phase of temperature increase a in the course of which the temperature T of the chamber 1 rises to a set predetermined temperature $T_0$ chosen by the user, then a regulation phase in the course of which the temperature T of the chamber 1 is regulated relative to said set temperature $T_0$ by means of a thermostatic device 7 known per se.

Referring now to FIGS. 3A, 3B, 3C, 3D which are curves of power P drawn as a function of time t.

Figure 3A:
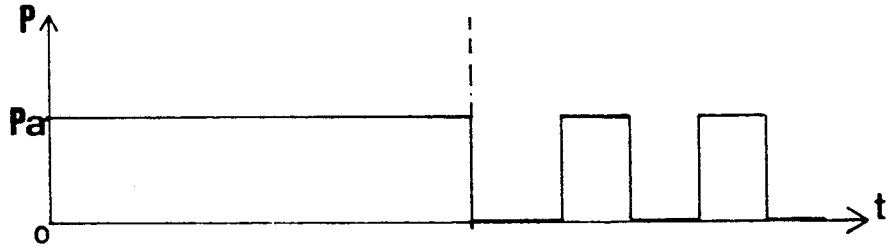
FIGS. 3A, 3B, 3C, 3D are graphical representations showing the sequence of the respective applications of the convection resistance, the broiling resistance, the microwave energy for a set time equal to 45% and of microwave energy for a set time equal to 90%.
Figure 3B:
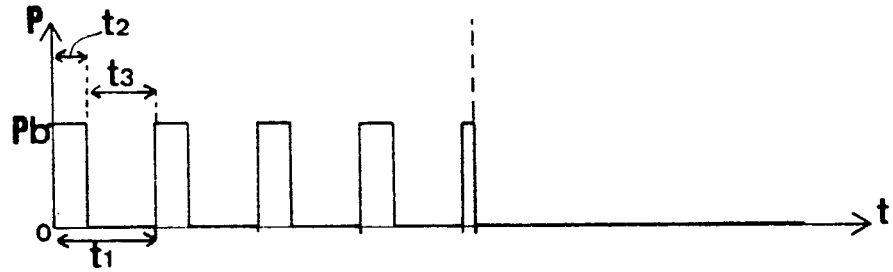

According to the invention, the cooking process performed by said oven is characterized in that during the temperature increase phase a, the control device 2 supplies the convection resistance 3 continuously at full power Pa (see FIG. 3A). The broiling resistance 4 is supplied according to a stop-start cycle whose period $t_1$ is predetermined by the manufacturer (see FIG. 3B). Said cycle has, during a period $t_1$, an operation time $t_2$ which is substantially half the stopped time $t_3$, and preferably selected to be about 10 seconds. Thus, during a period $t_1$ of 30 seconds, the broiling resistance 4 is supplied with maximum used power $P_b$ of 1400 watts for an operation time $t_2$ of 10 seconds and is stopped for a stop time $t_3$ of 20 seconds (which is to say a stopped time $t_3$ of about 66% of the period $t_1$).

Figure 3C:
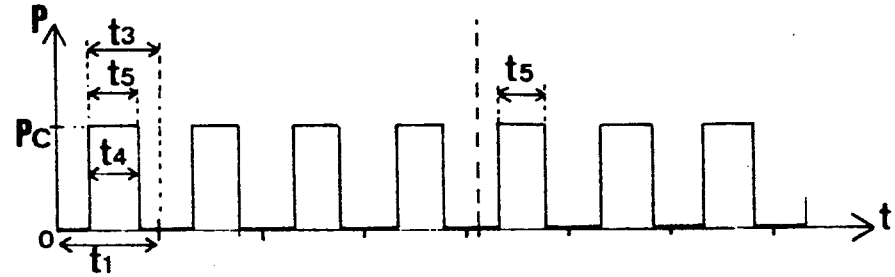
Figure 3D:
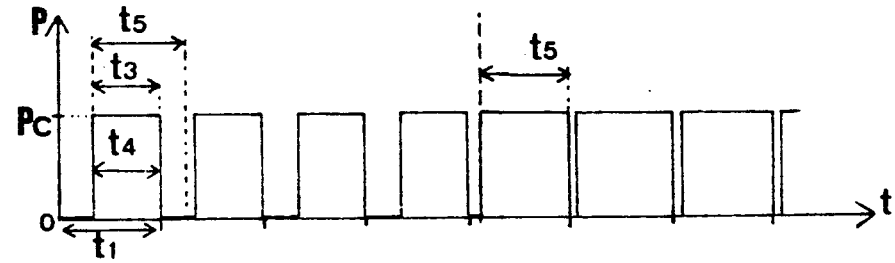

During temperature increase phase a, the microwave energy is applied periodically during each stopped time $t_3$ of the broiling resistance 4 for a time of application $t_4$ such that, for a predetermined time $t_5$ preliminarily set by the user, said duration $t_4$ is equal to the shorter of the two times, namely the set time $t_5$ (FIG. 3C), or the stopped time $t_3$ of the broiling resistance 4 (FIG. 3D).

Thus, the microwave energy being applied only during the stopped times $t_3$ of the broiling resistance 4, the rated power is never exceeded. There thus results, either convection and microwaves with the sum $P_a+P_c$ of the maximum utilized powers equal to 2800 watts, or convection and broiling with the sum $P_a+P_b$ of the maximum used powers equal to 2900 watts.

The supply of the broiler 4 always takes priority over the microwave energy. Thus, if the user desires more microwave energy than is permitted by the available power relative to the rated power, then the microwave energy is automatically cut off by the control device to permit the broiler to follow its normal cycle.

The operation during temperature increase phase a is thus quite simple.

The user first sets the predetermined temperature $T_0$ and a predetermined time $t_5$ for the microwave energy. The predetermined time $t_5$ is translated automatically by a computer (not shown) integrated with the control device 2 and a percentage of the period $t_1$, this percentage thus acting on the microwave power which is used.

Then cooking begins. The convection resistance 3 is continuously supplied and the broiling resistance 4 follows its stop-start cycle while the microwave energy is applied according to two types of sequences according to the user's choice.

In a first type of sequence, if the user sets a predetermined time $t_5$ less than the stopped time $t_3$ of the broiling resistance 4 (see FIG. 3C in which the predetermined time $t_5$ is, for example, selected to be about 45% of the period $t_1$, the time of application $t_4$ of microwave energy is equal to the predetermined time $t_5$).

According to a second type of sequence, if the user selects a predetermined time $t_5$ greater than the stopped time $t_3$ of the broiling resistance 4 (see FIG. 3D in which the predetermined time $t_5$ is, for example, selected to be about 90% of the period $t_1$), the application time $t_4$ of microwave energy will be the stopped time $t_3$ of the broiling resistance 4.

Thanks to these sequences of the use of convection, broiling and microwave energy, the temperature increase phase a is substantially reduced. Thus for a predetermined temperature $T_0$ of 250° C. and a predetermined time $t_5$ of 90%, the temperature increase phase a lasts for about 10 minutes instead of 20 minutes in an oven that does not use the process according to the invention.

According to another characteristic of the invention, during the regulated phase b, the control device 2 cuts off power to the broiling resistance 4 and feeds the convection resistance 3 by means of the thermostatic device 7 as long as the temperature T of the chamber 1 is less than the predetermined temperature $T_0$, while the microwave energy is applied periodically during the predetermined time $t_5$, independently of the supply of the convection resistance 3.

Thus, the broiling resistance being cut off, there is no risk of exceeding the rated power and the microwave energy is applied as a function of the predetermined time selected by the user.

What is claimed is:

1. In a cooking process using an oven heated by the combination of microwave, convection and broiling, comprising a cooking chamber (1) and a control device (2) supplying, from a source of electrical energy of limited rated power, a convection resistance (3), a broiling resistance (4) and a magnetron (5) during two cooking phases (a, b), said two cooking phases comprising a temperature increase phase (a) during which the temperature (T) of the chamber (1) increases to a predetermined temperature (T0) set by a user, and then a regulated phase (b) in the course of which the temperature (T) of the chamber (1) is regulated relative to said predetermined temperature (T0), by means of a thermostatic device (7), the sum of the powers drawn respectively by the two resistances (3, 4) and the microwave energy being less than the rated power of the energy source; the improvement wherein during the temperature increase phase (a), the control device (2) supplies the convection resistance (3) continuously at full power and the broiling resistance (4) according to a start-stop cycle whose period (t1) is predetermined, while the microwave energy is periodically applied during each stopped time (t3) of the broiling resistance (4) for a duration of application (t4) such that, for a predetermined time (t5) previously set by the user, said duration (t4) is equal to the shorter of two times comprising said predetermined time (t5) and said stopped time (t3) of the broiling resistance (4).

2. Cooking process according to claim 1, wherein during the regulated phase (b), the control device (2) cuts off the supply to the broiling resistance (4) and supplies the convection resistance (3) by means of the thermostatic device (7) as long as the temperature (T) of the chamber (1) is less than the predetermined temperature (T0), while the microwave energy is applied periodically during the predetermined time (t5), independently of the supply to the convection resistance (3).

3. Cooking process according to claim 1, wherein the maximum powers absorbed by the microwaves, the convection resistance and the broiling resistance are respectively about 1400, 1400 and 1500 watts.

4. Cooking process according to claim 1, wherein during the temperature increase phase (a), the cycle of the broiling resistance has, for a period (t1), an operating time (t2) which is substantially half the stopped time (t3).

5. In a cooking process in a chamber heated by convection, broiling and microwaves, according to a cooking cycle having two phases, said two phases comprising a temperature increase phase in the course of which the temperature within the chamber increases to a predetermined temperature selected by a user, followed by a regulated phase in the course of which the temperature of the chamber is regulated relative to said predetermined temperature; the improvement comprising, during said temperature increase phase, applying convection heating continuously from a convection resistance, applying broiling heating intermittently from a broiling resistance, and applying microwave heating only during the periods when said broiling heating is off.

* * * * *